United States Patent [19]

Gusakov

[11] Patent Number: 4,860,397

[45] Date of Patent: Aug. 29, 1989

[54] PNEUMATIC CUSHION

[75] Inventor: Ignaty Gusakov, E. Aurora, N.Y.

[73] Assignee: Gaymar Industries, Inc., Orchard Park, N.Y.

[21] Appl. No.: 232,992

[22] Filed: Aug. 17, 1988

[51] Int. Cl.[4] ..... A47C 27/08

[52] U.S. Cl. ..... 5/455; 5/441; 297/DIG. 3; 297/DIG. 8

[58] Field of Search ..... 5/455, 449, 441, 450, 5/451, 457, 454; 297/DIG. 3, DIG. 8; 428/178

[56] References Cited

U.S. PATENT DOCUMENTS

| | | | |
|---|---|---|---|
| 2,434,641 | 1/1948 | Burns | 5/449 |
| 4,076,872 | 2/1978 | Lewicki et al. | 428/178 |
| 4,741,057 | 5/1988 | Rosier et al. | 5/455 |

FOREIGN PATENT DOCUMENTS

| | | | |
|---|---|---|---|
| 787421 | 12/1957 | United Kingdom | 5/457 |

*Primary Examiner*—Alexander Grosz

*Attorney, Agent, or Firm*—Witherspoon & Hargest

[57] ABSTRACT

A pneumatic cushion having preinflated sealed cells with pressure compensators for distributing air between cells in response to loads placed thereon, the pneumatic cushion having a mid sheet with top and bottom surfaces, a top layer of preinflated sealed cells attached to the top surface of the mid sheet, a bottom layer of preinflated sealed cells attached to the bottom surface of the mid sheet, and pressure compensators affixed to the mid sheet and in communication with each top and bottom cell whereby upon uneven loading of the sealed cells air is stepwise transferred by the pressure compensators from a cell of high pressure on a first layer to a cell on a second layer and then to another cell on the first and so on to smooth out the uneven pressure.

9 Claims, 4 Drawing Sheets

BELLOWS COMPENSATORS

DOME COMPENSATORS

DIAPHRAGM (ELASTIC) COMPENSATORS

FIG. 1
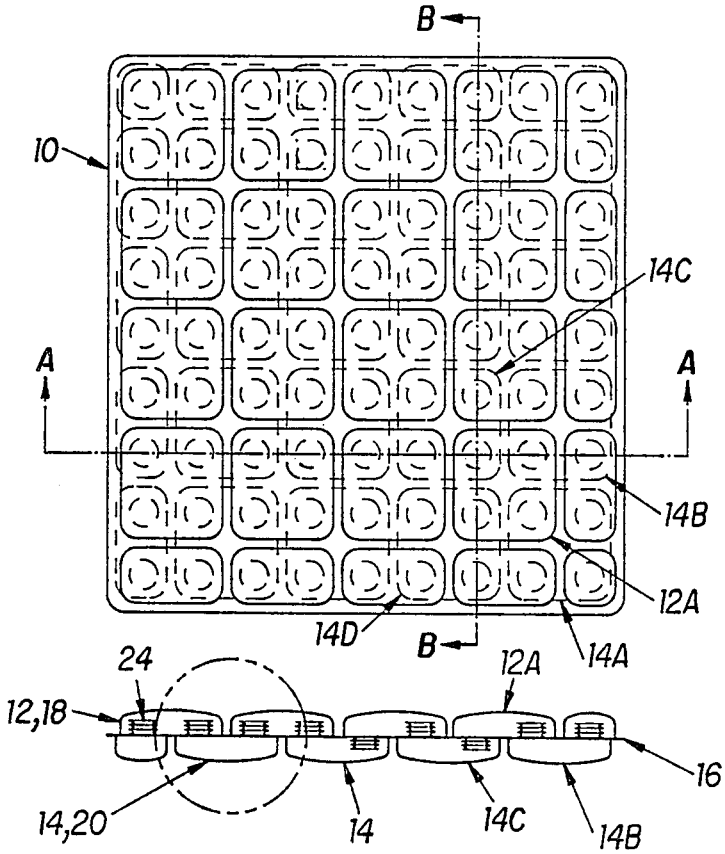
FIG. 3
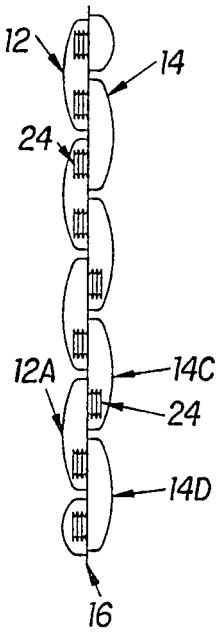
FIG. 2
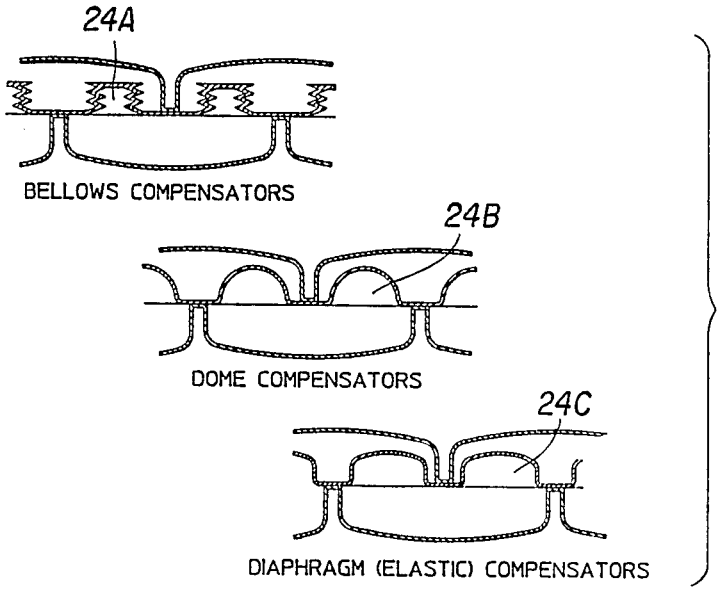
FIG. 4

PNEUMATIC CUSHION

The invention relates to pneumatic cushions particularly adaptable for use in connection wigh chairs or beds. More specifically the pneumatic cushion of this invention has sealed air chabmers and pressure compensator means for localized surface deflection.

Persons who must spend great amounts of time lying in bed or sitting in chairs among other problems are prone to experience pressure sores. Much attention has been given to this problem with many and varied solutions. Even so, it has been generally agreed that concentrated pressure areas caused by the patient's prominences result in reduced circulation in such body areas thus producing patient discomfort in the form of pressure sores.

Solutions to this specific problem, i.e. pressure sores are of many different types such as convoluted foam pads of various thicknesses, gel pads, static, and cyclically pressurized air cushions and water mattresses. All of the foregoing appear to have certain outstanding characteristics and have received a share of the commewrcial market. Even so, none of the pressure cushion units have met with universal and overwhelming success.

OBJECTS AND SUMMARY OF THE INVENTION

In view of the foregoing it is an object of this invention to provide a sealed pneumatic cushion having pressure distribution means.

It is another object of this invention to provide a sealed pneumatic cushion having means to reduce and equalize pressure at stress points produced by prominences of the patient.

It is yet another object of this invention to provide a pneumatic cushion wherein the cushion comprises a top layer of inflated sealed cells and a bottom layer of inflated sealed cells said cells being interconnected by pressure compensators which will transfer air from a top to a bottom cell.

It is a still further object to provide the pneumatic cushion as set forth in the immediately preceding objects and wherein under local deflection of an upper or bottom cell a distribution of pressure radiates outwardly from such deflection.

It is a further object of this invention to provide a pneumatic cushion of the type set forth in the preceding objects and wherein individual air leaks in some of the cells will not render the cushion inoperative.

The above objects are achieved by the preferred embodiment of this invention wherein the pneumatic cushion comprises a top layer of inflated and sealed cells and a bottom layer of inflated and sealed cells said upper cells being interconnected with the bottom cells by pressure compensators which transfer air from upper cells to bottom cells to transfer pressure from a high pressure point outwardly to gradually reduce said high pressure.

IN THE DRAWINGS

FIG. 1 is a top plan view of the basic pneumatic cushion which as shown is a chair cushion suitable for use on a wheelchair, FIG. 2 is a cross sectional view taken along line A—A of FIG. 1 illustrating the relative positioning of top and bottom cells and the pressure compensators located therein, FIG. 3 is a cross sectional view taken along line B—B of FIG. 1 to further show the symmetrical relationship of top and bottom cells and cooperating pressure compensators, and FIG. 4 shows three constructions of the pressure compensator namely; bellows compensator, dome compensator and diaphragm compensator, FIG. 5 is a sectional perspective view of the pneumatic cushion in non-use condition, FIG. 6 is a sectional perspective view of the cushion as shown in FIG. 5 with a patient resting on the top cells and the bottom cells being positioned on a suitable base of a chair or mattress, FIG. 7 is a cross sectional view of the pneumatic cushion with the profile of a seated patient projected thereon illustrating the displacement of the pressure compensators under a bony prominence, and FIG. 8 shows the pneumatic cushion of this invention when enlarged to fit on a bed.

DETAILED DESCRIPTION

Figure 5:
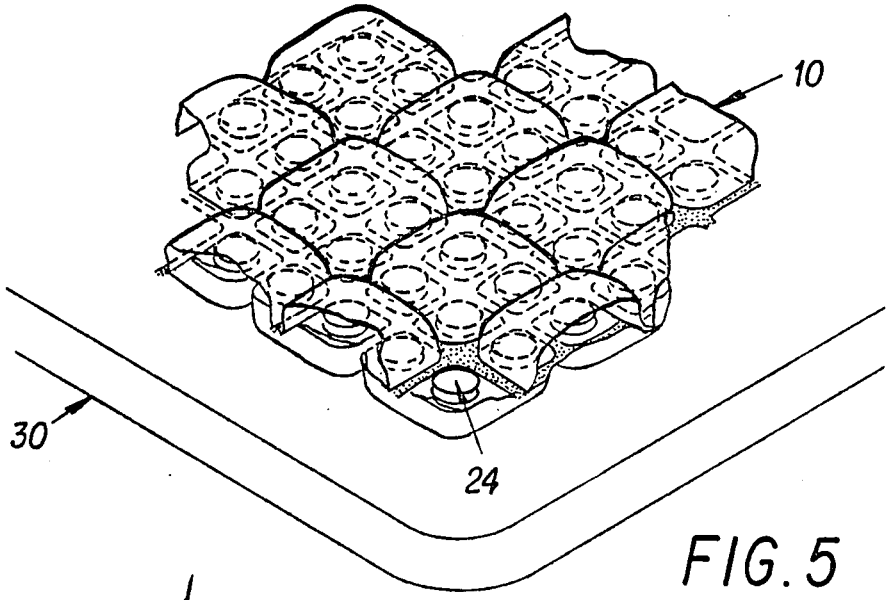

The pneumatic cushion covered by this invention is illustrated in plan in FIG. 1 and sectional and elevational condition in FIGS. 2–8. The pneumatic cushion has a plurality of preinflated sealed top cells and a plurality of preinflated sealed bottom cells. These cells are provided with pressure compensators for distributing air between the cells in response to uneven loads placed thereon.

More particularly, as shown in FIGS. 1–7, the pneumatic cushion 10 comprises a top layer consisting of preinflated sealed cells 12 of rectangular configuration and a bottom layer consisting of preinflated sealed cells 14 also of rectangular configuration. It should be noted that the basic cell whether top or bottom is of the same size and configuration except for edge cell portions.

The top layer of cells 12 is attached by heat sealing to a mid layer sheet 16 on which is formed a plurality of pressure compensators 24. Top cells 12 are formed from a top layer sheet 18 and are symmetrically arranged as clearly shown in FIG. 1. The bottom layer of cells 14 comprises a plurality of rectangular inflated and sealed bottom cells 14 formed from a bottom layer sheet 20. Said bottom cells 14 are heat sealed onto the underside of mid layer sheet 16. It is readily apparent that the mid layer sheet 16 may comprise on assembly of an upper sheet **16*a* and a lower sheet 16*b* secured together. See FIG. 7**.

As previously set forth, the top cells 12 and the bottom cells 14 are rectangular in configuration and of the same size. Thus the specific arrangement and relationship of top to bottom cells is provided wherein the top and bottom cells are medially offset both in the horizontal and vertical direction as shown in FIG. 1 whereby a given full top cell 12 will cover the contiguous corners of four separate bottom cells 14. This arrangement also applies to edge portions of the top and bottom layers of cells wherein a full cell is not formed.

The above arrangement is quite important to the proper functioning of the pressure compensation system of this invention. More specifically, a plurality of pressure compensators 24 are formed in the mid layer sheet 16. These pressure compensators may be diaphragms or bellows or domes of elastic material which are flexible so that they will flex in the direction of least pressure between the top and bottom cells when arranged as set forth earlier. In other words the pressure ocmpensators 24 are positioned so that they coincide with the corner portions of the cells, both top and bottom. This concept is clearly shown by FIGS. 2 and 3 combined with FIG. 1. For example, referring to FIGS. 1–3, top cell 12A covers the contiguous corners of bottom cells 14A, 14B, 14C and 14D. In FIGS. 2 and 3 the pressure compensators 24 are shown in slightly offset condition. This has been done for the sake of clarity. Actually when there is no load the compensators will be in a collapsed condition and almost flush with the mid layer sheet 16. FIG. 4 shows the configurations of the compensators. The compensators in general have been identified by the numeral 24. More specifically, in FIG. 4 the top broken away section illustrates bellows type compensator 24A while the mid broken away section shows dome type compensator 24B and the lower broken away section shows diaphragm compensator 24C which is made of elastic material.

Figure 6:
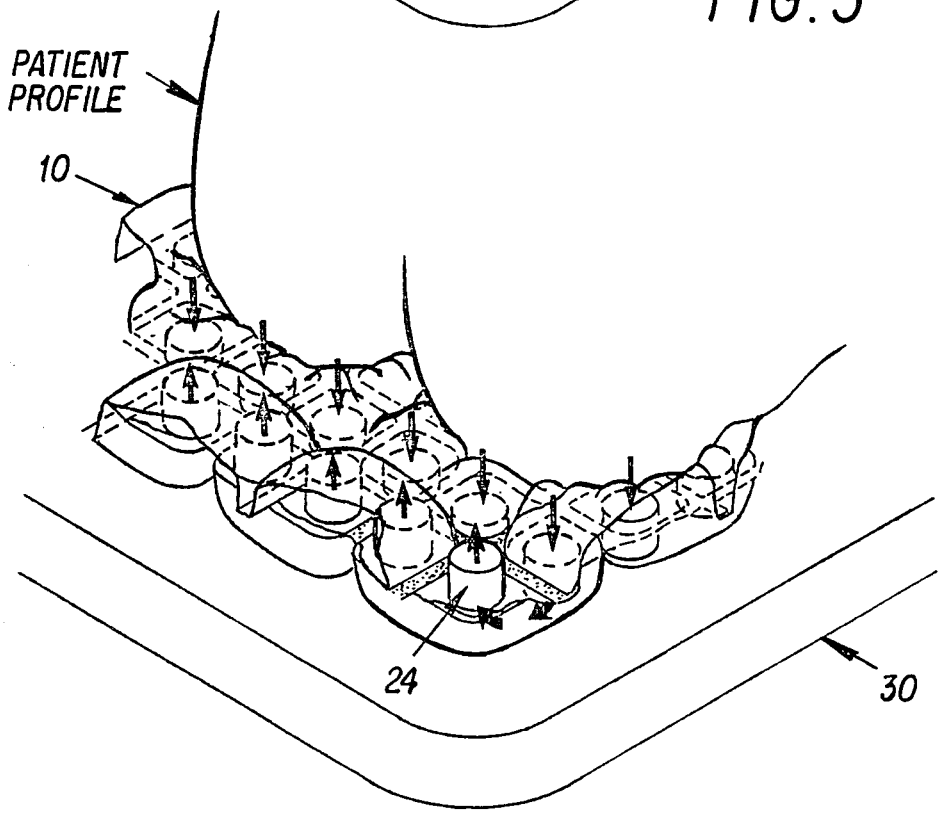
Figure 7:
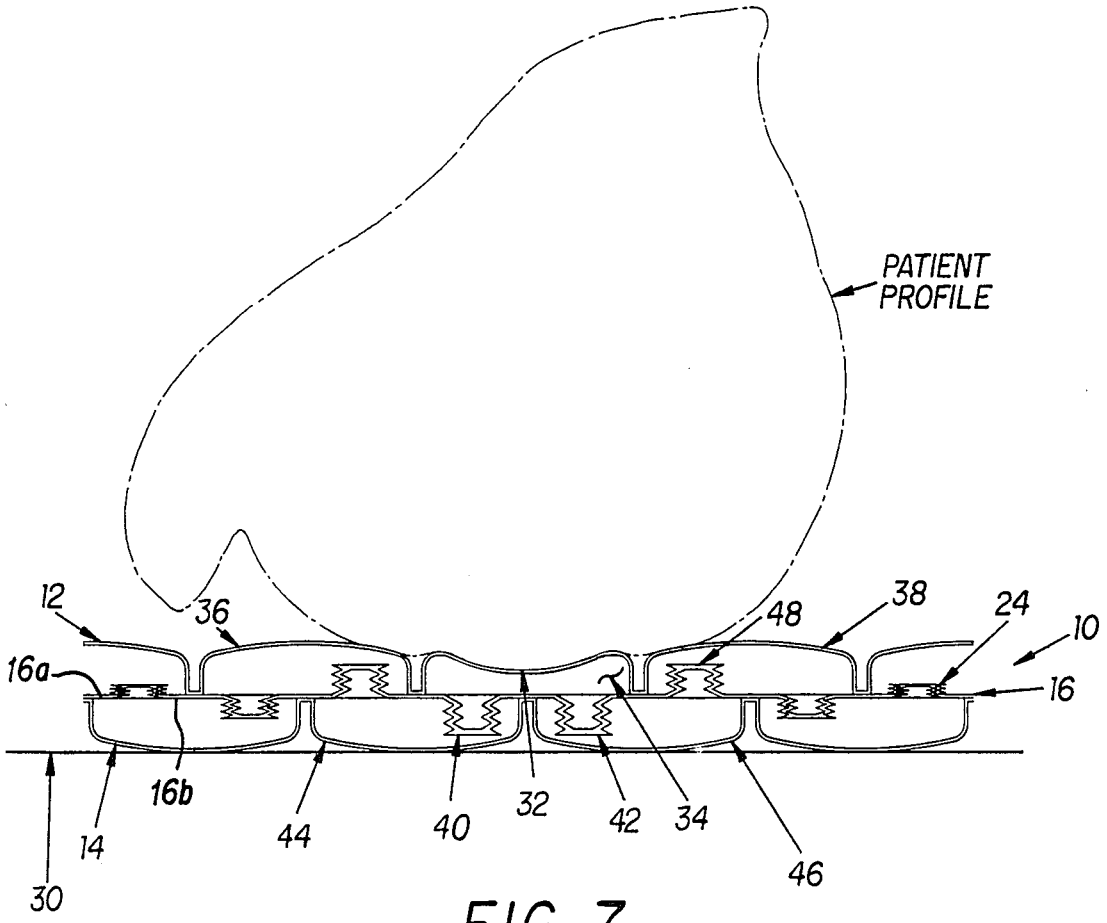

In order to describe the operation or the pneumatic cushion 10 reference is made to FIGS. 5, 6 and 7 wherein there is shown a base 30 such as a chair seat on which is positioned the pneumatic cushion 10 of this invention. A patient is seated on the top side of the cushion and has a profile as shown in shaded manner in FIG. 7. The profile includes a bony prominence 32 which causes the pressure in top cell 34 to increase beyond that experienced in adjacent top layer cells 36 and 38. Without further action there would be additional and undersirable pressure on prominence 32. This additional pressure causes pressure compensators 40 and 42 to expand into bottom cells 44 and 46 respectively thereby relieving the effective pressure in top cell 34. The action is continuous because when compensator 42 moves down into bottom cell 46 increased pressure is created therein causing compensator 48 to move upwardly into top cell 38. In fact four compensators will move upwardly into the four contiguous corners of adjacent top cells. This sequence was explained earlier. Thus it might be said that the pressure compensation is rapid because it expands into many cells in a radiating fashion. Such redistribution of pressure greatly aids in adjusting pressure in top cell 34 into which the prominence extends.

It will thus be noted that all cells both top and bottom are always independently sealed whereby movement of the pressure compensators into cells whether top or bottom produces pressure differences adapted to somewhat equalize and reduce the pressure at the patients prominences as they are positioned on the cushion.

Figure 8:
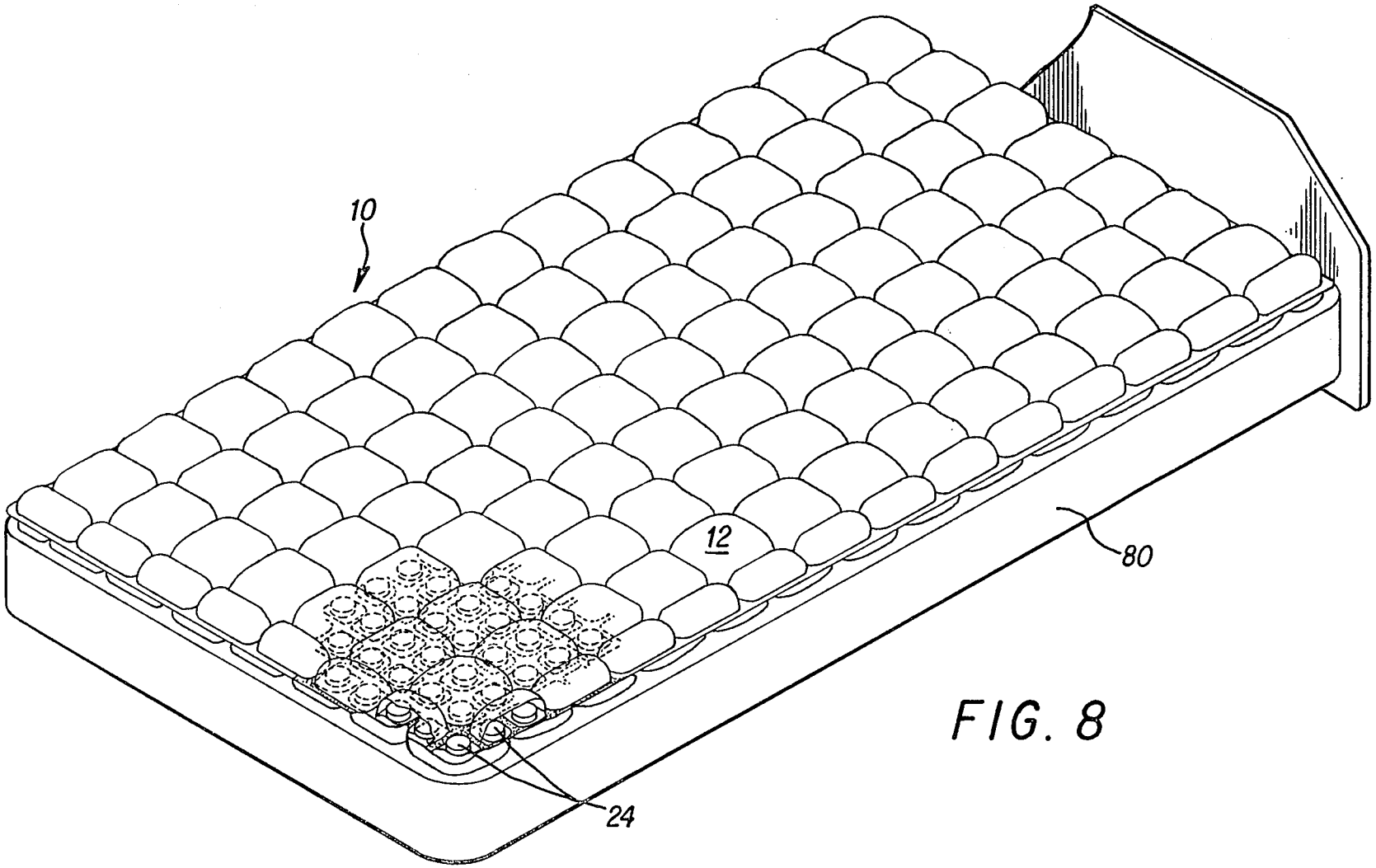

FIG. 8 shows the pneumatic cushion 10 of this invention positioned on a bed base 80 in no load condition with the pressure compensators 24 in the deflated condition. The broken away and phantom portion shows the manner in which the pressure compensators 24 actively cooperate with top and bottom cells.

With regard to materils from which the cushion may be made the field is almost endless. The sheets forming the cells and the mid layer sheet should be made of a heat sealable material which is readily formable. The material thickness should be sufficient to provide the requisite strength and durability. When the pressure compensators are shaped for elastic deformation obviously the mid-layer must be elastic in nature.

What is claimed is:

1. A pneumatic cushion having preinflated sealed cells with pressure compensators for distributing air between cells in response to loads placed thereon, said pneumatic cushion comprising:

(1) a mid sheet having top and bottom surfaces, (2) a top layer of preinflated sealed cells attached to the top surface of the mid sheet, (3) a bottom layer of preinflated sealed cells attached to the bottom surface of the mid sheet, and (4) pressure compensating means affixed to the mid sheet and in communication with each top and bottom cell whereby upon uneven loading of the sealed cells air is stepwise transferred by said pressure compensating means from a cell of high pressure on a top layer to a cell on a bottom layer and then to another cell on the said top and so on to smooth out the uneven pressure.

2. The invention as set forth in claim 1 and wherein the top preinflated cells and the bottom preinflated cells are arranged so that a top cell overlaps at least two bottom cells and each bottom cell overlaps at least two top cells, the pressure compensating means being in communication with successive top and bottom cells to smooth out the uneven pressure.

3. The invention as set forth in claim 2 and wherein the pressure compensating means comprises a plurality of pressure compensators attached to the mid sheet, said pressure compensators being in communication with each top cell and the bottom cell it overlaps.

4. The invention as set forth in claim 3 and wherein the pressure compensators are flexible bellows which transfer air from one cell to another.

5. The invention as set forth in claim 3 and wherein the pressure compensators are elastic hollow members which transfer air from one cell to another.

6. A pneumatic cushion having preinflated sealed cells with pressure compensators for distributing air between cells in response to loads placed thereon, said pneumatic cushion comprising:

(1) a top layer of preinflated sealed cells, (2) a bottom layer of preinflated sealed cells attached to the top layer so that the cells of both layers are exposed, top and bottom, (3) said top layer comprising a mid layer sheet having a plurality of rectangular inflated and sealed top cells formed from a top layer sheet attached thereto, said top cells being symmetrically arrayed on the mid layer sheet, (4) said bottom layer of cells comprising a plurality of rectangular inflated and sealed bottom cells formed from a bottom layer sheet attached to the mid layer sheet and on the opposite side from the rectangular top cells having longitudinal and width-wise sides said bottom cells being of identical configuration to the top cells and symmetrically arrayed whereby they are medially offset with respect to both the longitudinal and widthwise sides of the top cells so that a top cell will cover the contiguous corners of four separate bottom cells, and (5) pressure compensating means affixed to the mid layer sheet and in communication with each top and bottom cell whereby upon uneven loading of the cushion cells air is transferred from cell to cell to reduce such uneven loading of the cells.

7. The invention as set forth in claim 6 and wherein the pressure ocmpensating means comprises a plurality of bellows like members attached to the the mid layer sheet and in communication with both the top and the bottom cells.

8. The invention as set forth in claim 6 and wherein each complete top cell has four pressure compensators cooperating with the corner portions of the four bottom cells it overlies.

9. A pneumatic cushion having preinflated sealed cells with air compensators for distributing pressure between cells in response to loads placed thereon,s aid pneumatic cushion comprising:

(1) a mid-layer sheet assembly comprising an upper and a lower sheet secured together, (2) a top layer of preinflated sealed cells attached to the upper sheet, (3) a bottom layer of preinflated sealed cells attached to the lower sheet so that the cells of both layers are exposed, top and bottom, (4) said top layer comprising the mid layer top sheet having a plurality of rectangular inflated and sealed top cells formed from a top layer sheet attached thereto, said top cells being symmetrically arrayed on the mid layer sheet, (5) said bottom layer of cells comprising a plurality of rectangular inflated and sealed bottom cells formed from a bottom layer sheet attached to the mid layer lower sheet and on the opposite side from the rectangular top cells having longitudinal and widthwise sides said bottom cells being of identical configuration to the top cells and symmetrically arrayed whereby they are medially offset with respect to both the longitudinal and widthwise sides of the top cells so that a top cell will cover the contiguous corners of four separate bottom cells, and (6) pressure compensating means affixed to the mid layer sheet assembly and in communication with each top and bottom cell whereby upon uneven loading of the sealed cells, air is transferred from cell to cell to reduce such uneven loading of the cells.

* * * * *